US011192754B2

(12) United States Patent
Haapaniemi et al.

(10) Patent No.: US 11,192,754 B2
(45) Date of Patent: Dec. 7, 2021

(54) ELEVATOR ARRANGEMENT AND ELEVATOR

(71) Applicant: Kone Corporation, Helsinki (FI)

(72) Inventors: Markku Haapaniemi, Helsinki (FI); Ari Kattainen, Helsinki (FI); Janne Mikkonen, Helsinki (FI); Matti Rasanen, Helsinki (FI); Esko Aulanko, Kerava (FI)

(73) Assignee: Kone Corporation, Helsinki (FI)

( * ) Notice: Subject to any disclaimer, the term of this patent is extended or adjusted under 35 U.S.C. 154(b) by 331 days.

(21) Appl. No.: 16/221,711

(22) Filed: Dec. 17, 2018

(65) Prior Publication Data

US 2019/0112158 A1 Apr. 18, 2019

Related U.S. Application Data

(63) Continuation of application No. PCT/FI2016/050523, filed on Jul. 15, 2016.

(51) Int. Cl.
*B66B 11/02* (2006.01)
*B66B 5/00* (2006.01)

(52) U.S. Cl.
CPC ..... *B66B 11/0246* (2013.01); *B66B 5/005* (2013.01); *B66B 5/0087* (2013.01)

(58) Field of Classification Search
CPC ..... B66B 5/0087; B66B 11/0246
See application file for complete search history.

(56) References Cited

U.S. PATENT DOCUMENTS

| | | | | |
|---|---|---|---|---|
| 6,202,801 | B1 * | 3/2001 | Muller | B66B 11/0246 187/269 |
| 2007/0056810 | A1 * | 3/2007 | Fernandes | B66B 5/00 187/401 |
| 2010/0200339 | A1 | 8/2010 | Henseler | |

FOREIGN PATENT DOCUMENTS

| | | | |
|---|---|---|---|
| CN | 202643048 | U | 1/2013 |
| EP | 1433734 | A1 | 6/2004 |
| EP | 2277817 | A1 | 1/2011 |
| JP | 2000016725 | A | 1/2000 |
| JP | 2015027898 | A * | 2/2015 |

OTHER PUBLICATIONS

Machine Translation of JP 2015-027898.*
International Search Report for International Application No. PCT/FI2016/050523 publsihed Apr. 24, 2017.
Written Opinion of the International Searching Authority for International Application No. PCT/FI2016/050523 Published Apr. 24, 2017.
Chinese Office Action dated May 20, 2021 for Chinese Application No. 2016800875231.

* cited by examiner

*Primary Examiner* — Diem M Tran
(74) *Attorney, Agent, or Firm* — Harness, Dickey & Pierce, P.L.C.

(57) ABSTRACT

An elevator arrangement including an elevator with an elevator control system, a safety system and an inspection or maintenance mode, which elevator having an elevator car arranged to run up and down in an elevator shaft along guide rails, and which elevator car is equipped with a roof. The roof of the elevator car is arranged to uncover upper part of the elevator car in order to form a natural safe working space inside the elevator car, and that the arrangement includes a control mechanism in order to control the position of the roof.

20 Claims, 4 Drawing Sheets

ELEVATOR ARRANGEMENT AND ELEVATOR

CROSS-REFERENCE TO RELATED APPLICATIONS

This application is a continuation of PCT International Application No. PCT/FI2016/050523 which has an International filing date of Jul. 15, 2016, the entire contents of which are incorporated herein by reference.

FIELD OF THE INVENTION

The present invention relates to an elevator arrangement.

This invention relates particularly to an elevator where a headroom is low. The headroom in this context means the clearance between the roof of the elevator car and the ceiling of the elevator shaft in the situation when the elevator car is at its uppermost position. In an advantageous solution the headroom can be so low that the height of the elevator shaft is equal to the height of the floors of the building. In that case the elevator shaft can be totally inside the building.

Many kinds of tasks, such as tests, inspections, adjustment works, maintenance or repairs, later referred in a shorter way only as "maintenance work", are often performed at the upper part of the elevator shaft. In that case the safety of the persons performing the tasks mentioned above has always to be secured. If the height of the top clearance of the elevator shaft is low, in other words the headroom is low, a sufficient safety space, which prevents injuries occurring for persons working on the roof of the elevator car, cannot always be guaranteed without special procedures.

BACKGROUND OF THE INVENTION

Standards such as EN81 require certain minimum safety distances between elevator car and the top and the bottom of the elevator shaft to provide a person a safe working space when he/she is accessing to the machines and shaft components. A safety space is a natural one if suitable clearance is available without shortening the stroke of the elevator car. In some cases natural safe working spaces are not possible to provide, because the elevator shaft is not tall enough and thus there is no room in the elevator shaft above the topmost position of the elevator car and/or below the lowest position of the elevator car. In such cases artificial safety spaces can be created. The artificial safety space creation requires additional equipment, such as brakes or movable buffers, and particular safety considerations.

Usually the maintenance work is done on the roof of the elevator car. In that case, when working on the roof of the elevator car an unintentional movement of the elevator car must be prevented in some other way than by the regular operating brakes of the elevator. It is known in the prior art that this kind of prevention can be done by locking the elevator car and/or the counterweight into their positions on the guide rail, for instance by means of a safety gear, a latch or wedges. However, this often requires that the working persons must separately go to the elevator shaft and perform the locking. That makes safety preparation tasks awkward, laborious and time-consuming.

Another solution according to prior art for achieving an adequate safety space in the upper part of an elevator shaft is to use one or more turnable buffers that are disposed below the counterweight. The buffer is lifted upright before going onto the roof of the elevator car. The length of the buffer is such that the movement of the counterweight, and at the same time the movement of the elevator car, stops before the elevator car rises too high with respect to the ceiling of the elevator shaft. One problem, among others, in this solution is, however, that the shaft space might have been dimensioned so precisely that there is no proper space in the bottom part of the elevator shaft for a turnable buffer. Another problem is that the aforementioned buffer ensuring the top safety space is in the bottom part of the elevator shaft, i.e. right at the other end of the elevator shaft. In that case installing the buffer into the safe position takes extra time and it may also happen that for this reason the person in charge does not remember to go down to the bottom of the elevator shaft to turn them into the safe position.

In addition to the aforementioned, the safety solutions are often based on electrical supervision controls installed in the doors of the shaft, which controls must be switched to the safe position before going onto the roof of the elevator car. Turning the buffers into the safe position and activation of the electrical control circuits are often such a complex combination that, particularly e.g. with small tasks, they might be left undone owing to their complexity and for saving the time used. In addition, electrical supervision control systems could be susceptible to failure.

Yet one solution according to the prior art is shown in the US patent publication No. US2010/0200339 A1. The solution according to the US publication presents an elevator safety system for elevators with a reduced upper end of the elevator shaft. In this solution the roof of the elevator car cannot be used as a working base, because the roof of the elevator car is constructed so that it does not support weight. Thus, it is not possible to be or work on the roof of the elevator car. In this case the required free safety space is formed completely inside the elevator car when the elevator car is in its uppermost position. As the roof is not designed to bear loads, in such a situation a weight on the roof may deform or even broke the roof structures. The maintenance work at the top part of the elevator shaft is done inside the elevator car. For this purpose a part of the sidewall of the car is made removable and the maintenance work is done though the opening in the sidewall when the part mentioned above has been removed from the sidewall. However, the problem in this solution is the fact that there are only limited possibilities to make inspection, repair and maintenance work because only one certain opening is used. And likewise there are limited possibilities to place elevator appliances that require regular maintenance in the elevator shaft because the opening is only at one sidewall of the car. In addition the opening makes the wall structure more expensive, more complicated and also weaker than the unbroken wall structure.

When making maintenance work the elevator is set to the maintenance mode which prevents the normal use of the elevator and, for instance, calling the elevator car from landing floors. Also landing doors cannot be open and an access to the elevator shaft is prevented. However, in that case landing doors can be opened by a special key, for instance with a so-called triangle key. This brings out a new problem because those special keys are easily available. In that case unauthorized persons can acquire that kind of special key and open the landing doors of the elevator shafts for their own purposes. This increases risks of accidents. Another problem is that mechanic solutions to open the landing doors increase the costs of the elevator and also cause visual problems in the door area of elevators because additional holes must be done into doors in every floor.

SUMMARY

One objective of the present invention is to eliminate drawbacks of prior art technology and to achieve an elevator arrangement where the headroom at the upper part of the elevator shaft can be as low as possible, and the elevator shaft is completely inside the building so that there is no need to penetrate the roof of the building. Another objective of the present invention is to create a safe working space inside the elevator car for maintenance work of the elevator appliances in the elevator shaft and the top part of the elevator car. Yet another objective of the present invention is to achieve a control mechanism to control the position of roof of the elevator car and also if weight greater than the predefined weight is aimed onto the roof of the elevator car. And yet another objective of the present invention is to achieve a safety arrangement that is operationally extremely reliable, easy and fast to use, and that immediately prevents the movement of the elevator car if somebody steps onto the roof of the elevator car. Yet another objective of the present invention is to achieve an elevator arrangement where there is no need to open landing doors for doing maintenance work of the elevator appliances in the elevator shaft.

The elevator arrangement according to the invention is characterized by the claims.

A preferred aspect of the elevator arrangement and the elevator of the invention is enabling the movement of the elevator car only when the roof of the car is fully opened or fully closed. In fully closed and in fully opened positions the roof can be easily locked to its position and it is also easy to monitor, that the roof holds its locked position.

The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. Likewise the different details presented in connection with each embodiment can also be applied in other embodiments. In addition it can be stated that at least some of the subordinate claims can, in at least some situations, be deemed to be inventive in their own right.

In order to achieve the objectives of the present invention the roof of the elevator car is opened for creating a safe working space inside the elevator car for maintenance work and for enabling the elevator shaft maintenance work and also maintenance of equipment located adjacent to the elevator car top. And in order to sufficient safety the position of the movable roof is electrically controlled.

In order to achieve the objectives mentioned above, the present invention provides an elevator arrangement comprising an elevator with an elevator a control system, a safety system and an inspection or maintenance mode, which elevator having an elevator car arranged to run up and down in an elevator shaft along guide rails, and which elevator car is equipped with a roof. Advantageously the roof of the elevator car is arranged to uncover upper part of the elevator car to form a natural safe working space for conducting inspection and maintenance tasks from inside the elevator car to the elevator shaft and to form the refuge space inside the elevator car, and that the arrangement comprises a control mechanism in order to control the position of the roof.

Advantageously the control mechanism comprises at least a trigger element and control switches activated by the movement of the trigger element and operatively connected at least to the elevator control system and to the elevator safety system. Further, the trigger element is arranged to move in connection with the movement of the roof of the elevator car.

One advantage of the invention is that the invention enables maintenance work for the appliances at the top part of the elevator shaft without the need to step onto the roof of the elevator car. Thus, all the maintenance work can be done from inside the elevator car. Another advantage of the solution according to the invention is that a safe working space for elevator maintenance work is created inside the elevator car. Yet another advantage of the solution according to the invention is that a movement of the elevator car can be effectively, reliably and safely prevented if somebody steps onto the roof of the elevator car or there is more weight than a predetermined value allows on the roof of the elevator car.

One further advantage of the invention is that the invention enables a safe way of providing an elevator that has an extremely low top clearance or headroom. The top clearance can even be minimized to the minimum, or close to the minimum, required only by the trajectory of the elevator car. Thus when the elevator car is in its uppermost possible position on its trajectory, the shaft space above the elevator car is small and the height of the elevator shaft can easily be fitted inside the building, without penetrating the roof of the building.

Yet another advantage is that the solution is very easy and quick to use, and does require neither awkward working in the elevator shaft nor preliminary procedures at the top end or bottom end of the elevator shaft. Yet a further advantage is also that the solution is inexpensive and simple to implement. Yet a further advantage is that uplifted roof of the elevator car protects the working person in the elevator car from possible falling objects in the elevator shaft.

Yet another advantage of the solution according to the invention is that the number of control switches for safety functions can be reduced to minimum.

Yet another advantage of the solution according to the invention is that there is no need to open the landing doors for maintenance purposes and therefore the special key to open the landing doors are not needed. That also effectively prevents an authorized access onto the roof of the elevator car.

Also there is no need to make holes in the door leaves for the special keys, and no need to arrange complex special opening mechanisms in door structures. That makes the outward appearance of the landing doors look better and prevents unauthorized persons to open the landing doors with special keys they have copied or acquired without authorizing license.

BRIEF DESCRIPTION OF THE DRAWINGS

In the following, the invention will be described in detail by the aid of example embodiments by referring to the attached simplified and diagrammatic drawings, wherein.

DETAILED DESCRIPTION

An aspect of the invention is to achieve an elevator arrangement with an elevator car having an easily openable and controllable roof which makes it possible to access maintenance and repair targets in an elevator shaft and in the outer upper part of the elevator car from inside the elevator car, and which also removes the need to step onto the roof of the elevator car, and in addition to that, also reduces the height of the shaft needed.

Figure 1:
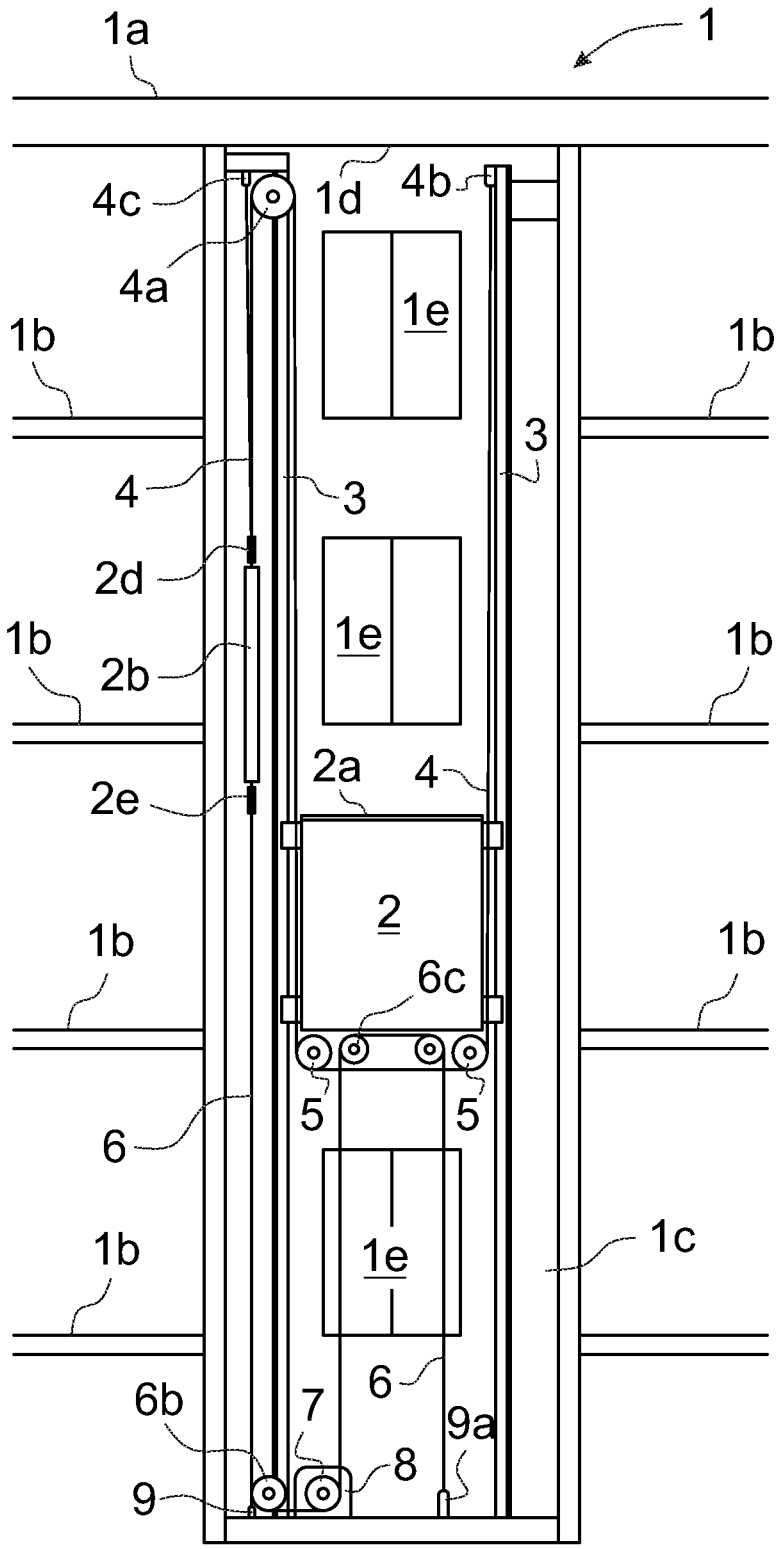
FIG. 1 presents in a simplified and diagrammatic back view a part of the building where the back wall of the elevator shaft is removed, and an elevator in the elevator shaft, in which elevator the solution according to the invention can be used.

FIG. 1 presents in a simplified and diagrammatic back view a part of the building 1 where the back wall of the elevator shaft 1*c* is removed, and an elevator in the elevator shaft 1*c*, in which elevator the solution according to the invention can be used. The building 1 has a roof 1*a* just above the elevator shaft 1*c* and four floors 1*b* served by the elevator.

The elevator comprises among other things an elevator car 2 with an openable roof 2*a*, which elevator car 2 is arranged to run up and down in the elevator shaft 1*c* along guide rails 3, and a counterweight or balance weight 2*b* that is also arranged to run up and down in the elevator shaft 1*c* along its guide rails which are not presented in FIG. 1 for the sake of clarity. Later in this connection only balance weight 2*b* is mentioned when either counterweight or balance weight is meant.

Advantageously the supporting and moving of the elevator car 2 are separated from each other. This makes it possible to achieve an elevator structure where the height of the headroom above the elevator car 2 can be as low as possible. The elevator car 2 is driven by a hoisting machinery 8 equipped with a drive wheel 7. Advantageously the hoisting machinery 8 is located at the bottom part of the elevator shaft 1*c*, below the elevator car 2 and advantageously below the first floor level 1*b*.

A traction member 6 is connected between the balance weight 2*b* and the elevator car 2. The traction member 6 can be a single member or a bunch of similar parallel members, for instance, the traction member 6 can be a toothed belt, chain or other type of member that does not slip on the drive wheel 7. In this embodiment the suspension ratio of the traction member 6 is 2:1. In that case the first end of the traction member 6 is secured at its first fastening point 9, for example at the bottom part of the elevator shaft 1*c*. From the first fastening point 9 the traction member 6 is led upwards to go over and around a traction sheave 2*e* in connection with the balance weight 2*b* and from the traction sheave 2*e* the traction member 6 is led downwards to go under and around a diverting pulley 6*b* and the drive wheel 7 of the hoisting machinery 8 at the bottom part of the elevator shaft 1*c*, from where the traction member 6 continues upwards to go over and around diverting pulleys 6*c* at the bottom of the elevator car 2 and from the diverting pulleys 6*c* again downwards to its second fastening point 9*a* where the second end of the traction member 6 is secured, for example at the bottom part of the elevator shaft 1*c*.

The elevator car 2 is suspended by suspension element 4 that is connected between the balance weight 2*b* and the elevator car 2. The suspension element 4 can be a single member or a bunch of similar parallel members, for instance suspension ropes. In this embodiment the suspension ratio of the suspension element 4 is 2:1. In that case the first ends of the suspension element 4 are secured at their first fastening point 4*c*, for example at the top part of the guide rail 3, from which the suspension element 4 is led downwards to go under and around a diverting pulley 2*d* in connection with the balance weight 2*b*. From the diverting pulley 2*d* the suspension element 4 is led upwards to go over and around a diverting pulley 4*a* that is fitted with bearings on its shaft, for instance at the upper part of the guide rail 3. From the diverting pulley 4*a* the suspension element 4 descends downwards to go under and around diverting pulleys 5 at the bottom of the elevator car 2 and from the diverting pulleys 5 the suspension element 4 is led upwards to its second fastening point 4*b* where the second end of the suspension element 4 is secured, for example at the top part of the guide rail 3. The elevator car 2 is also equipped with safety gear system that is arranged to stop the movement of the elevator car 2 and to lock the elevator car 2 into the guide rails 2 when needed. Thanks to the suspension like this the roof 2*a* of the elevator car 2 can be openable, which means that greatest part of the upper part of the elevator car (2) can be uncovered in order to expose a manhole for performing maintenance, test, inspection and/or repair works, etc. in the elevator shaft 1*c* and at top part of the elevator car 2.

Each floor has a landing door 1*e* that is presented in FIG. 1 seen from the direction of the elevator shaft 1*c*. In addition the elevator comprises at least an operating system, a control system, an electrical system, a variety of sensor arrangements and a safety system comprising an inspection mode, which inspection mode is here a common term for the operation mode which is activated when performing inspection, test, maintenance or repair work or other operations that require a safe working environment.

Figure 2:
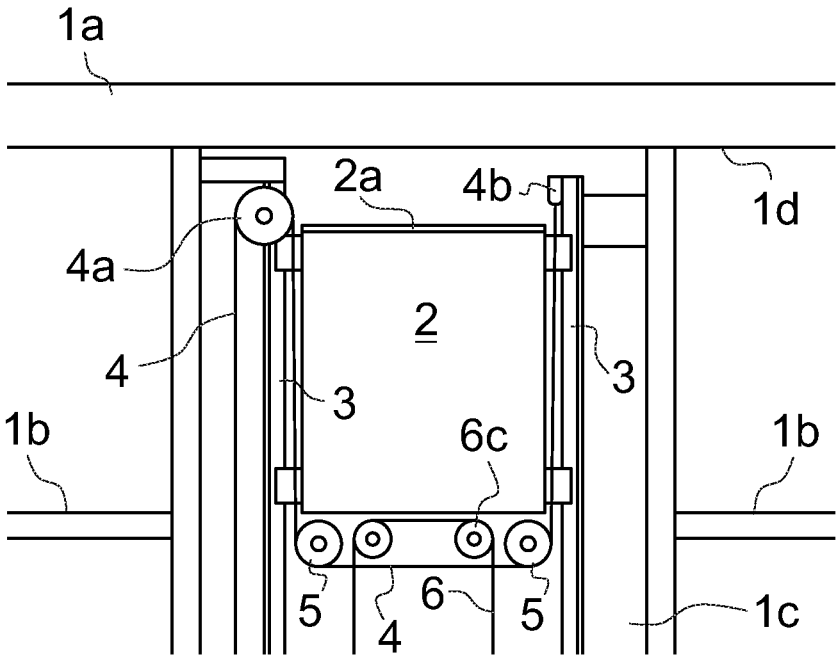
FIG. 2 presents in a simplified and diagrammatic back view the upper part of the elevator shaft in the building according to FIG. 1.

FIG. 2 presents in a simplified and diagrammatic back view the upper part of the elevator shaft 1*c* in the building 1 according to FIG. 1. Also in this figure the back wall of the elevator shaft 1*c* is removed and the elevator shaft 1*c* is seen from its backside. In the situation of FIG. 2 the elevator car 2 is in its uppermost floor 1*b* in the top part of the elevator shaft 1*c*. The top clearance between the roof 2*a* of the elevator car 2 and the ceiling 1*d* of the elevator shaft 1*c* is at its minimum. In that solution the height of the elevator shaft 1*c* is equal to the total height of the floors 1*b* of the building 1 or even less than the total height of the floors 1*b* of the building 1. In that case the elevator shaft 1*c* can be totally inside the building 1.

Figure 3:
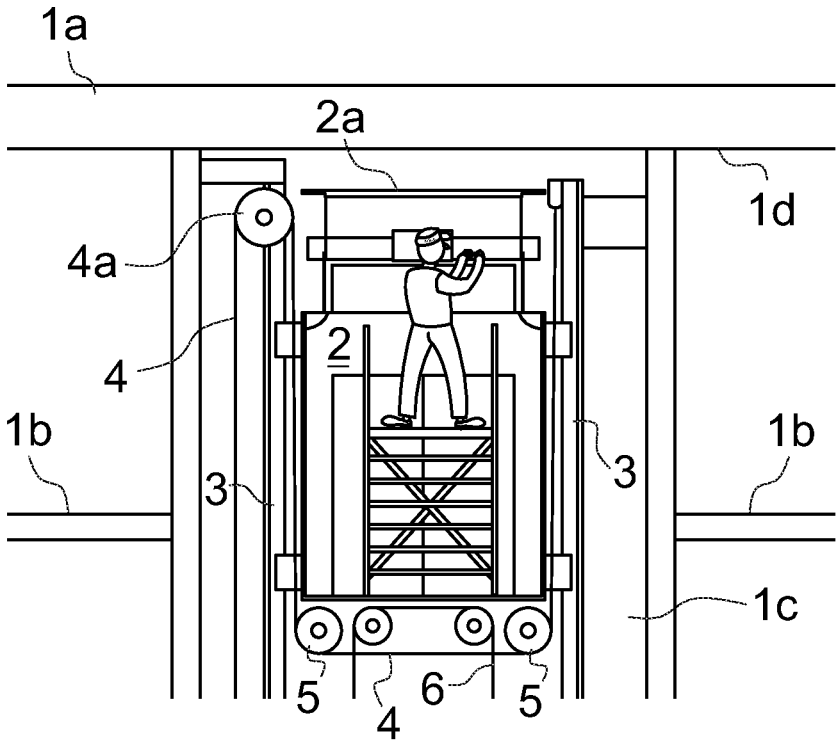
FIG. 3 presents in a simplified and diagrammatic back view the upper part of the elevator shaft in the building according to FIG. 1 in the situation where the maintenance or repair task is in progress.

FIG. 3 presents in a simplified and diagrammatic back view the upper part of the elevator shaft 1*c* in the building 1 according to FIG. 1 in the situation where the maintenance or repair task, etc. is in progress. The openable roof 2*a* of the elevator car 2 is opened, in this embodiment by lifting it upwards, and a maintenance hole or opening is created between the uplifted roof 2*a* and the upper edges of the elevator car 2. The elevator car 2 has been run with a service run or inspection run in an appropriate location in the elevator shaft 1*c* so that the working person being inside the elevator car 2 has an easy access to the elevator components and appliances in the elevator shaft. In this case the required safety space is created at least partly inside the elevator car 2. In case the maintenance work is done lower in the elevator shaft 1*c*, the uplifted roof 2*a* protects the working person also from falling tools and other objects that may fall down into the elevator shaft 1*c* from other working sites above, for instance from a top part of a neighboring elevator shaft where another elevator is installed at the same time.

Figure 4:
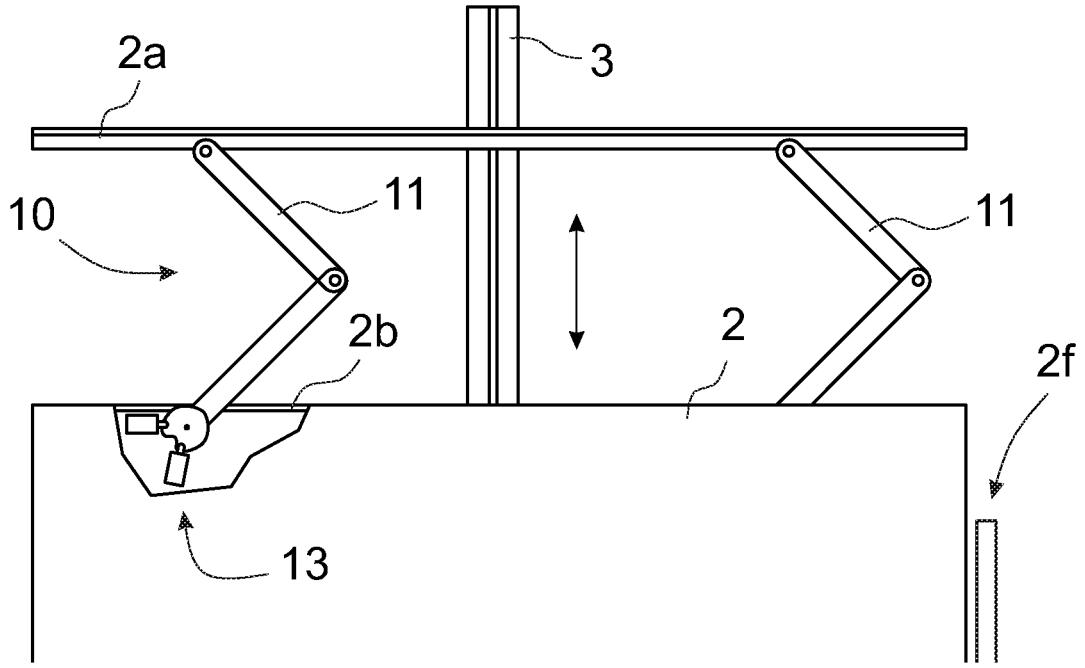
FIG. 4 presents in a simplified and diagrammatic side view an upper part of the elevator car according to the invention in a situation where the roof of the elevator car is opening for instance for maintenance work.

FIG. 4 presents in a simplified and diagrammatic view, an upper part of the elevator car 2 according to the invention. In FIG. 4 the roof 2*a* is partially open for a maintenance or repair work and supported by articulated arms 11 with lower, middle and upper pivot points. Partially open here means that the roof 2*a* is lifted upwards but it is not yet in its uppermost position. An uncovered manhole or opening 2*b* on top of the elevator car 2 makes it possible to reach the elevator appliances or components in the elevator shaft 1*c* from inside the elevator car 2 when the roof 2*a* is fully open, i.e. in its uppermost position. The vertical position of the roof 2*a* is controlled with an electrical control mechanism 13 that is installed at the lower part of at least one of the articulated arms 11 supporting the roof 2*a*.

In the embodiment of FIG. 4 the roof 2*a* is openable by lifting it straight upwards. For that purpose the elevator comprises opening means 10 that are arranged to open and close the roof 2*a* when the elevator is switched on to a safe inspection or maintenance mode, later in a shorter way referred only as "inspection mode". The moving of the roof 2*a* can be carried out in several ways. One way is to use the articulated arms 11 mentioned above and one or more actuators to turn the articulated arms 11. In this embodiment four articulated arms 11 are used, two pieces on each side of the elevator car 2. The articulated arms 11 help to lift and lower the roof 2*a*. The actuators to lift and lower the roof 2*a* are not presented in FIG. 4, but they can be, for instance, gas springs, screws driven by a crank or electric motor, springs associated with dampening gas springs, or the roof 2*a* can be even moved manually by pushing the roof 2*a* upwards and pulling it downwards. When lifting and lowering the roof 2*a* manually gas springs can be used to ease the lifting and to dampen the movement of the roof 2*a* when closing it so that the roof 2*a* does not unwantedly hit the upper edges of the elevator car 2.

Figure 5:
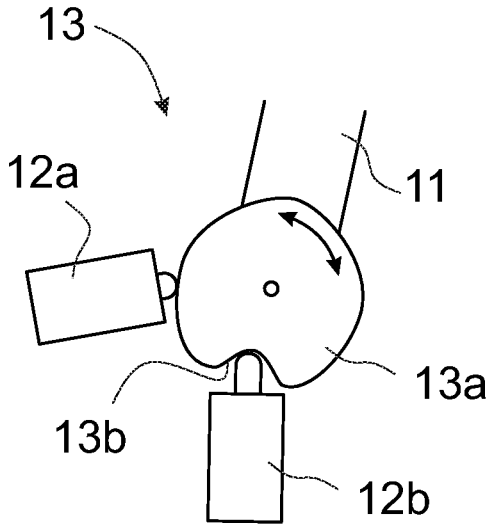
FIG. 5 presents in a simplified and diagrammatic and an enlarged side view a part of the electrical control mechanism according to the invention in order to control the position of the roof of the elevator car, in the situation where the roof is in its uppermost position.
Figure 6:
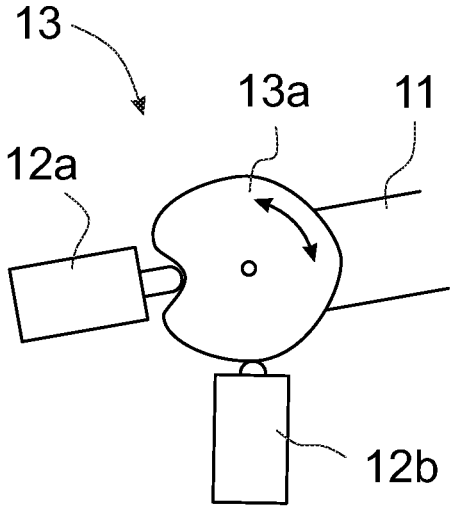
FIG. 6 presents in a simplified and diagrammatic and an enlarged side view a part of the electrical control mechanism according to the invention in order to control the position of the roof of the elevator car, in the situation where the roof is in its lowermost position.

FIGS. 5 and 6 present in a simplified, diagrammatic and an enlarged side view a part of the electrical control mechanism 13 according to the invention in order to control the position of the roof 2*a* of the elevator car 2. FIG. 5 presents the situation where the roof 2*a* is in its uppermost position, and FIG. 6 presents the situation where the roof 2*a* is in its lowermost position. The electrical control mechanism 13 comprises a trigger element 13*a* and at least two electrical control switches, a normal closed switch 12*a* or the first switch and a normal open switch 12*b* or the second switch, which switches 12*a*, 12*b* are operatively connected at least to the elevator control system and the elevator safety system. The trigger element 13*a* is, for example, a roundish disc that has convex outer edges on both sides of a concave recess 13*b* in the periphery of the disc. The trigger element 13*a* is fastened to the lower pivot point of at least one articulated arm 11 at the lower end of said articulated arm 11. So, the disc of the trigger element 13*a* turns or rotates along the lower part of the articulated arm 11 and at the same time the trigger element 13*a* rotates around its pivot point.

The control switches 12*a*, 12*b* are placed so that when the roof 2*a* is in its lowermost position the trigger of the normal closed switch 12*a* is in the recess 13*b* of the trigger element 13*a*. In that case the elevator control system has received a signal that the elevator is in a normal mode and that the elevator can be run in a normal mode.

When lifting the roof 2*a* the articulated arm 11 rotates around its lowermost pivot point and at the same time the trigger element 13*a* rotates around its pivot point. At that time the trigger element 13*a* changes the state of the normal closed switch 12*a* by pushing the trigger the normal closed switch 12*a* inwards, and as a result the power circuit that enables inspection mode opens. In that case the elevator control system receives a signal that the elevator is not any more in a normal mode and the elevator comes to a halt if the roof 2*a* has been tried to lift during a normal run of the elevator. If the elevator car 2 was not in motion the elevator cannot start running as long as the roof 2*a* is not in its uppermost position.

When the roof 2*a* has been lifted to its uppermost position the trigger of the normal open switch 12*b* hits the recess 13*b*, the power circuit that enables inspection mode closes and the normal open switch 12*b* sends the elevator control system a signal that the inspection mode is allowed. In that case the inspection run is allowed.

In case, when the roof 2*a* is in its lowermost position and the elevator is in the normal mode, somebody steps onto the roof 2*a* of the elevator car 2 the weight of the person presses the roof 2*a* downwards, the trigger element 13*a* rotates and the trigger of the normal closed switch 12*a* comes out from the recess 13*b* in which case the elevator control system receives a signal that the elevator is not any more in the normal mode. In that case neither the normal mode run nor the inspection run is allowed.

In an advantageous embodiment of the invention the electrical control mechanism 13 with its trigger element 13*a* and control switches 12*a*, 12*b* is also arranged to activate the safety gear of the elevator. In that case the safety gear comprises a solenoid that is controlled by the control switches 12*a*, 12*b*. When the control mechanism 13 triggers the solenoid it activates the safety gear in which case the movement of the elevator car 2 comes to its halt after a certain predetermined travel if the elevator car 2 starts to move. When the roof 2*a* reaches its uppermost position the normal open switch 12*b* is activated and the inspection run becomes allowed in the inspection mode.

The same control switches 12*a*, 12*b* can be arranged to control the lighting during the inspection run. In that case the lamps for the lighting are placed, for instance onto the roof 2*a* of the elevator car 2 or in the edges of the up moving roof 2*a*. In that case the lighting needs no additional switches.

Figure 7:
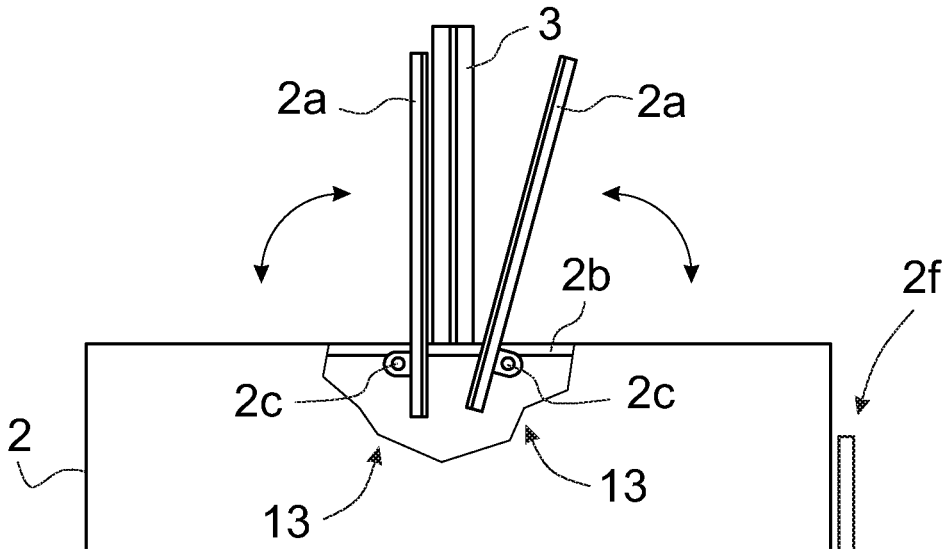
FIG. 7 presents in a simplified and diagrammatic side view an upper part of the elevator car according to another embodiment of the invention when the roof is partially open for maintenance work.

FIG. 7 presents in a simplified and diagrammatic side view an upper part of the elevator car 2 according to another embodiment of the invention when the roof 2*a* is open for maintenance or repair work and the position of the roof 2*a* is controlled by the electrical control mechanism 13. In this embodiment the roof 2*a* consists of two halves that are hinged with a hinge 2*c* at their first ends at the upper part of the sidewalls of the elevator car 2 in the middle area of the elevator car 2. Thus the halves of the roof 2*a* are closing towards the front edge and back edge of the elevator car 2 and opening towards the center of the elevator car 2. This gives more space for maintenance work in the backside of the elevator car 2 and in the front side of the elevator car 2 where, for example the door machinery is. An advantageous place for the trigger 13*a* of the electrical control mechanism 13 is in connection with the hinge 2*c*.

Figure 8:
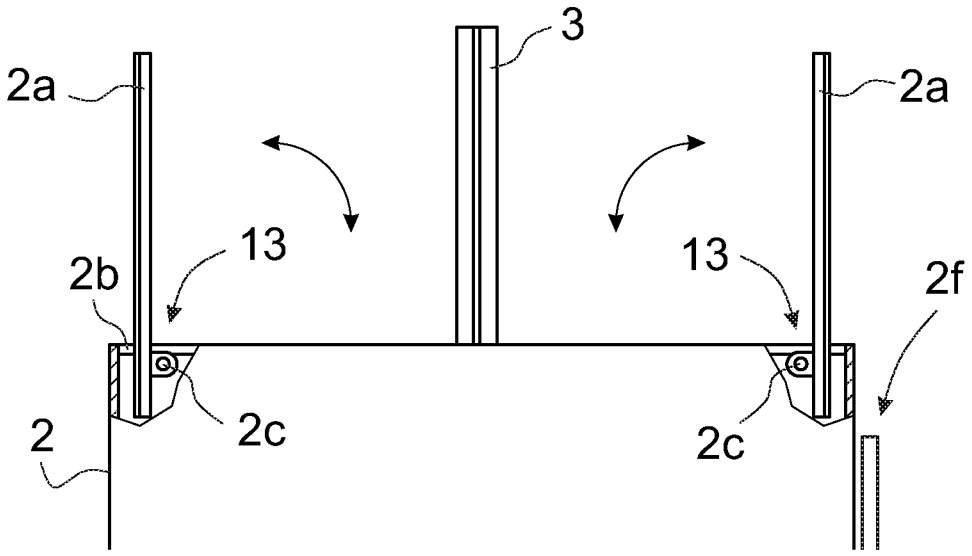
FIG. 8 presents in a simplified and diagrammatic side view an upper part of the elevator car according to yet another embodiment of the invention when the roof is open for maintenance work.

FIG. 8 presents in a simplified and diagrammatic side view an upper part of the elevator car 2 according to yet another embodiment of the invention when the roof 2*a* is open for maintenance or repair work and the position of the roof 2*a* is controlled by the electrical control mechanism 13. In this embodiment the roof 2*a* also consists of two halves that are hinged with a hinge 2*c* at their first ends at the upper part of the sidewalls of the elevator car 2. In this case the hinge points are close the front wall and back wall of the elevator car 2. In this case the halves of the roof 2*a* are closing towards the center of the elevator car 2 and opening towards the front edge and back edge of the elevator car 2. This gives more space for maintenance work in the sides of the elevator car 2 where, for example the guide rails are. An advantageous place for the trigger 13*a* of the electrical control mechanism 13 is in connection with the hinge 2*c*.

According to the invention the elevator car 2 has roof 2*a* that can be lifted upwards to create an access for maintenance purposes to the elevator appliances in the elevator shaft 1*c* and to elevator components at the upper part of the elevator car 2. The person performing maintenance tasks can stand in a good position on a special portable working surface that is placed inside the elevator car 2, and has an access to all the components that need maintenance. During the maintenance tasks the interior of the elevator car 2 is in this case a natural safe working space according to the elevator regulations. In addition the uppermost position of the uplifted roof 2*a* is arranged so that the cap between the roof 2*a* and the upper edges of the elevator car 2 is so small that the maintenance person cannot climb out from the elevator car 2 into the elevator shaft 1*c* and step onto the roof 2*a*. The walls of the elevator car 2 have been arranged to act as railings for the maintenance person.

The elevator arrangement also comprises a mechanical upper safety means to prevent the elevator car from colliding the ceiling 1*d* of the elevator shaft 1*c* when the inspection mode is witched on. The upper safety means is operatively connected to bi-directional safety brakes fastened to the elevator car 2.

It is obvious to the person skilled in the art that the invention is not restricted to the examples described above but that it may be varied within the scope of the claims presented below. Thus, for instance the roof of the elevator car and the mechanisms for opening and closing the roof can be different from what is presented above.

It is also obvious to the person skilled in the art that the suspension and/or traction ratio of the elevator car can be different from what is presented above. The suspension and/or traction ratio can be, for instance 1:1, the suspension ratio can also be 2:1 but the traction ratio 1:1. However, it is essential that the elevator structure is such that the roof of the elevator car can be easily opened.

It is further obvious to the person skilled in the art that the suspension and traction arrangement of the elevator car can be different from what is presented above. The location of the hoisting machinery can also be in the upper part of the elevator shaft, and the suspension and traction of the elevator car can be carried out in different ways, for instance with common hoisting ropes that suspend the elevator car and the balance weight and also move them.

It is still further obvious to the person skilled in the art that the electrical control mechanism in order to control the position of the roof of the elevator car can also be different from what is presented above.

The invention claimed is:

1. An elevator comprising:

an elevator car configured to move in an elevator shaft along guide rails, and the elevator car including a roof, the roof configured to move with respect to a body of the elevator car between a normally closed position and a fully open position such that, in the fully open position, inspection and maintenance tasks of the elevator shaft are performable from inside the elevator car while the elevator is operating in a maintenance mode; and a control mechanism configured to control the elevator car based on a position of the roof of the elevator car, the control mechanism including a trigger configured to move along with movement of the roof, and first and second control switches configured to activate as the trigger moves in response to the movement of the roof such that, when the roof is at the normally closed position, the trigger causes the first control switch to activate and the second control switch to deactivate to enable the elevator to run in a normal mode, and when the roof is at the fully opened position, the trigger causes the first control switch to deactivate and the second control switch to activate to enable the elevator to run in the maintenance mode.

2. The elevator according to claim 1, further comprising:

an articulating roof support configured to open and close the roof only when the elevator is operating in the maintenance mode.

3. The elevator according to claim 1, wherein the first and second control switches are connected at least to an elevator safety system.

4. The elevator according to claim 1, wherein the trigger is a disc with a convex outer edge and a concave recess in a periphery of the disc.

5. The elevator according to claim 4, wherein the control mechanism is configured to, set the elevator to the normal mode, when a trigger of the first control switch is in the concave recess to indicate that the roof of the elevator car is at the normally closed position, and set the elevator to the maintenance mode, when a trigger of the second control switch is in the concave recess to indicate that the roof of the elevator car is at the fully open position.

6. The elevator according to claim 5, further comprising:

articulated arms configured to support the roof of the elevator car, the articulated arms including a lower pivot point, a middle pivot point and an upper pivot point wherein the trigger is fastened to the lower pivot point of at least one of the articulated arms at a lower part thereof such that the trigger turns along the lower part of the articulated arm when the roof of the elevator car is opening or closing.

7. The elevator according to claim 1, wherein, while the roof is in the normally closed position, the trigger causes one or more of the first or second control switches to deactivate to prevent the elevator from running in both the normal mode and the maintenance mode, in response to the roof being pressed downwards by a weight on the roof.

8. The elevator according to claim 1, wherein the control mechanism is configured to activate safety gear of the elevator.

9. The elevator according to claim 1, wherein the control mechanism is configured to control lighting during the maintenance mode.

10. The elevator according to claim 2, wherein the articulating roof support is configured to open and close the roof essentially in a vertical direction.

11. The elevator according to claim 2, wherein the roof comprises:

two halves hinged at an upper central part of the elevator car, wherein the articulating roof support includes a pair of hinges configured to open and close respective ones of the halves of the roof by turning the halves towards a center of the elevator car when opening the halves and towards a plurality of car walls of the elevator car when closing the halves.

12. The elevator according to claim 2, wherein the roof comprises:

two halves hinged at an upper edge part of the elevator car, wherein the articulating roof support includes a pair of hinges configured to open and close respective ones of the halves of the roof by turning the halves towards a plurality of car walls of the elevator car when opening the halves and towards a center of the elevator car when closing the halves.

13. The elevator according to claim 1, wherein a height of the elevator shaft is equal to a total height of floors of the elevator.

14. An elevator configured to move in an elevator shaft along guide rails, the elevator comprising:

a movable roof configured to move with respect to a body of an elevator car between a normally closed position and a fully open position such that, in the fully open position, inspection and maintenance tasks of the elevator shaft are performable from inside the elevator car while the elevator is operating in a maintenance mode; and a control mechanism configured to control the elevator car based on a position of the movable roof of the elevator car, the control mechanism including a trigger configured to move along with movement of the movable roof, and first and second control switches configured to activate as the trigger moves in response to the movement of the movable roof such that, when the movable roof is at the normally closed position, the trigger causes the first control switch to activate and the second control switch to deactivate to enable the elevator to run in a normal mode, and when the movable roof is at the fully opened position, the trigger causes the first control switch to deactivate and the second control switch to activate to enable the elevator to run in the maintenance mode.

15. The elevator according to claim 14, further comprising:

an elevator control system configured to enable the elevator car to move in the elevator shaft only if the movable roof of the elevator car is at the fully opened position or the normally closed position.

16. The elevator according to claim 14, wherein the trigger includes a disc configured to rotate in response to movement of the movable roof, the disc having a recess therein.

17. The elevator of claim 16, wherein the disc has a convex outer edge and the recess is in a periphery thereof, the recess being concave.

18. The elevator according to claim 1, wherein during a transition between the normally closed position and the fully opened position, the trigger causes the first and second control switches to each deactivate to inhibit the elevator from running in both the normal mode and the maintenance mode.

19. The elevator according to claim 14, wherein, while the movable roof is in the normally closed position, the trigger causes one or more of the first or second control switches to deactivate to prevent the elevator from running in both the normal mode and the maintenance mode, in response to the movable roof being pressed downwards by a weight on the movable roof.

20. The elevator according to claim 14, wherein during a transition between the normally closed position and the fully opened position, the trigger causes the first and second control switches to each deactivate to inhibit the elevator from running in both the normal mode and the maintenance mode.

* * * * *